US007435327B2

(12) United States Patent
Rosenbaum et al.

(10) Patent No.: US 7,435,327 B2
(45) Date of Patent: Oct. 14, 2008

(54) HYDRAULIC OIL WITH EXCELLENT AIR RELEASE AND LOW FOAMING TENDENCY

(75) Inventors: John M. Rosenbaum, Richmond, CA (US); Susan M. Abernathy, Hercules, CA (US); Stephen J. Miller, San Francisco, CA (US); Nancy J. Bertrand, Lafayette, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 756 days.

(21) Appl. No.: 11/078,746

(22) Filed: Mar. 11, 2005

(65) Prior Publication Data

US 2006/0131210 A1 Jun. 22, 2006

Related U.S. Application Data

(60) Provisional application No. 60/637,171, filed on Dec. 16, 2004.

(51) Int. Cl.
*C10G 71/00* (2006.01)
*C10M 173/02* (2006.01)

(52) U.S. Cl. ..... 208/18; 508/126

(58) Field of Classification Search ..... 208/18, 208/180; 508/126
See application file for complete search history.

(56) References Cited

U.S. PATENT DOCUMENTS 6,090,758 A 7/2000 Pillon et al.
6,103,099 A 8/2000 Wittenbrink et al.

FOREIGN PATENT DOCUMENTS

WO WO00/14183 3/2000

*Primary Examiner*—Walter D. Griffin
*Assistant Examiner*—Frank C Campanell
(74) *Attorney, Agent, or Firm*—Susan M. Abernathy

(57) ABSTRACT

This invention provides a hydraulic oil comprising: 1) a lubricant base oil having an average molecular weight greater than 475, a viscosity index greater than 140, and a weight percent olefins less than 10; and 2) an antiwear hydraulic oil additive package. The hydraulic oil of this invention has an air release by ASTM D 3427-03 of less than 0.8 minutes at 50 degrees C., and a sequence II foam tendency by ASTM D 892-03 of less than 50 ml. We describe a process for making the hydraulic oil of this invention, and a method of operating a hydraulic pump without pump cavitation using the hydraulic oil of this invention.

21 Claims, No Drawings

HYDRAULIC OIL WITH EXCELLENT AIR RELEASE AND LOW FOAMING TENDENCY

This application claims the benefit of provisional Application No. 60/637,171, filed Dec. 16, 2004.

FIELD OF THE INVENTION

This invention is directed to a composition of hydraulic oil having excellent air release and foaming properties, a process for making the hydraulic oil, and a method of operating a hydraulic pump without pump cavitation.

BACKGROUND OF THE INVENTION

WO 00/14183 and U.S. Pat. No. 6,103,099 to ExxonMobil teach a process for producing an isoparaffinic lubricant base stock which comprises hydroisomerizing a waxy, paraffinic, Fischer-Tropsch synthesized hydrocarbon feed comprising 650-750° F.+hydrocarbons, said hydroisomerization conducted at a conversion level of said 650-750° F.+feed hydrocarbons sufficient to produce a 650-750° F.+hydroisomerate base stock which comprises said base stock which, when combined with at least one lubricant additive, will form a lubricant meeting desired specifications. Hydraulic oils are claimed, but nothing is taught regarding processes to make or compositions of hydraulic oils having especially good air release, low foaming, or good additive solubility.

U.S. Pat. No. 6,090,758 to ExxonMobil teaches a method for reducing foaming of lubricating oils which comprise a wax isomerate base stock made from Fischer-Tropsch wax, said method comprising adding to the oil an antifoamant or solvent solution thereof, consisting of a high molecular weight polydimethyl siloxane oil with specific viscosity and spreading coefficient. Nothing is taught regarding processes to make or compositions of hydraulic oils having air release times of less than 1.0 minutes at 50 degrees C.

Castrol Anvol SWX® FM ISO 46 hydraulic oil has an air release by ASTM D 3427 of less than 0.5 minutes at 50 degrees C., a viscosity index of 183, demulsibility by ASTM D 1401 of 25 minutes, and sequence II foam tendency by ASTM D 892 of 80 ml. It is made from a polyol ester lubricant base oil having high fire resistance, low tendency to form varnish, and good biodegradability. Polyol ester lubricant base oils are very expensive. Because they cost much more than conventional hydraulic oil, polyol ester-based fluids are used primarily in applications where fire resistance, environmental compatibility, or both justify the higher expense. Castrol Anvol SWX® FM is a registered trademark of Castrol Industrial Americas.

What is desired is a hydraulic oil with very low air release and improved foam tendencies, and a process to make it. Preferably the hydraulic oil will be made using a high quality base oil that is readily available and at prices competitive to conventional Group II and Group III base oils.

SUMMARY OF THE INVENTION

We have discovered a hydraulic oil with exceptionally low air release and improved foam stability. It is a hydraulic oil comprising: 1) a lubricant base oil having an average molecular weight greater than 475, a viscosity index greater than 140, and a weight percent olefins less than 10; and 2) an antiwear hydraulic oil additive package. The hydraulic oil of this invention has an air release by ASTM D 3427-03 of less than 0.8 minutes at 50 degrees C., and a sequence II foam tendency by ASTM D 892-03 of less than 50 ml.

We have also discovered a hydraulic oil comprising: a) between 10 and 99.9 weight percent based on the total hydraulic oil of a lubricant base oil having an average molecular weight greater than 475, a viscosity index greater than 140, and a weight percent olefins less than 10; and b) between 0.1 and 15 weight percent based on the total hydraulic oil of an antiwear hydraulic oil additive package, wherein the hydraulic oil has an air release of less than 0.8 minutes at 50 degrees C. by ASTM D 3427-03, a sequence II foam tendency of less than 50 ml by ASTM D 892-03 less than 50 ml, and a number of minutes to 3 ml emulsion at 54 degrees C. by ASTM D 1401-02 of less than 30.

We have invented a process for making a hydraulic oil with very low air release and improved foam tendencies. The process comprises the steps of a) selecting a waxy feed having greater than 75 wt % n-paraffins and less than 25 ppm total combined nitrogen and sulfur; b) hydroisomerization dewaxing the waxy feed to produce a lubricant base oil; c) fractionating the lubricant base oil into one or more fractions; d) selecting one or more of the fractions having an average molecular weight greater than 475, a viscosity index greater than 140, a weight percent olefins less than 10; and e) blending the one or more selected fractions with an antiwear hydraulic oil additive package to produce a hydraulic oil having an air release at 50 degrees C. by ASTM D 3427-03 of less than 0.8 minutes.

In addition we have invented a method of operating a hydraulic pump, comprising a) filling a hydraulic system oil reservoir with a hydraulic oil comprising a lubricant base oil having an average molecular weight greater than 475; a viscosity index greater than 140; and a weight percent olefins less than 10; and an antiwear hydraulic oil additive package (wherein the hydraulic oil has an air release at 50 degrees C. by ASTM D 3427-03 of less than 0.8 minutes); and b) operating the hydraulic pump supplied with the hydraulic oil from the filled oil reservoir; wherein the hydraulic pump operates without pump cavitation.

DETAILED DESCRIPTION

Air release properties are generally associated with the base oil composition and kinematic viscosity. Air release properties are measured by ASTM D 3427-03.

The air release test is done by saturating the fluid (normally at 50° C., but other temperatures such as 25° C. are also possible) with air bubbles and then measuring the time it takes for the fluid to return to an air content of 0.2%. Air release times are generally longer for Group I base oils than for Group III base oils. Polyol ester, polyalphaolefin, and phosphate ester base oils typically have lower air release than conventional mineral oils. Typical air release specifications for hydraulic oils vary from 5 minutes maximum for ISO 32 oils, through 7 minutes maximum for ISO 46 oils, through 17 minutes maximum for ISO 150 oils. Air release values generally increase with viscosity of the base oil.

Good air release is a critical property for hydraulic oils. Agitation of hydraulic oil with air in equipment, such as bearings, couplings, gears, pumps, and oil return lines, may produce a dispersion of finely divided air bubbles in the oil. If the residence time in the hydraulic system reservoir is too short to allow the air bubbles to rise to the oil surface, a mixture of air and oil will circulate through the hydraulic system. This may result in an inability to maintain oil pressure, incomplete oil films in bearings and gears, and poor hydraulic system performance or failure. The inability to maintain oil pressure is especially pronounced with hydraulic systems having centrifugal pumps. Oil having poor air release can cause sponginess and lack of sensitivity of the control of turbine and hydraulic systems.

One of the most severe effects of a hydraulic oil having poor air release is pump cavitation. Cavitation of the hydraulic pump is evidenced primarily by increased pump noise and excessive pump vibration, and also by loss of high pressure in the hydraulic system or loss of speed in hydraulic system cylinders. When the hydraulic oil being pumped in a hydraulic system enters the pump inlet the pressure is significantly reduced. The greater the flow velocity through the pump the greater the pressure drop. If the pressure drop is high enough, and the hydraulic oil has poor air release, the air contained in the hydraulic oil is carried into the pump as small bubbles. As the hydraulic oil flow velocity decreases the fluid pressure increases, causing the air bubbles to suddenly collapse on the outer portions of the pump impeller. The formation of the air bubbles and their subsequent collapse is referred to as pump cavitation. The hydraulic pump may be seriously damaged by cavitation.

Air release is measured by ASTM D 3427-03. Compressed air is blown through the test oil, which has been heated to a temperature of 25 or 50 degrees C. After the air flow is stopped, the time required for the air entrained in the oil to reduce in volume to 0.2% is recorded. The air release time is the number of minutes needed for air entrained in the oil to reduce in volume to 0.2% under the conditions of the test and at the specified temperature. Air release is mainly a function of the base stock, and oils need to be monitored for this. Additives cannot positively influence air release time. The air releases of the hydraulic oils of this invention are very low, generally less than 0.8 minutes at 50 degrees C., preferably less than 0.5 minutes at 50 degrees C. Additionally, they preferably have an air release at 25 degrees C. less than 10 minutes, more preferably less than 5 minutes at 25 degrees C.

Foam tendency and stability are measured by ASTM D 892-03. ASTM D 892-03 measures the foaming characteristics of a lubricating base oil at 24 degrees C. and 93.5 degrees C. It provides a means of empirically rating the foaming tendency and stability of the foam. The lubricating base oil, maintained at a temperature of 24 degrees C., is blown with air at a constant rate for 5 minutes then allowed to settle for 10 minutes. The volume of foam, in ml, is measured at the end of both periods (sequence 1). The foaming tendency is provided by the first measurement, the foam stability by the second measurement. The test is repeated using a new portion of the lubricating base oil at 93.5 degrees C. (sequence II); however the settling time is reduced to one minute. For ASTM D 892-03 sequence III the same sample is used from sequence II, after the foam has collapsed and cooled to 24 degrees C. The lubricating base oil is blown with dry air for 5 minutes, and then settled for 10 minutes. The foam tendency and stability are again measured, and reported in ml. A good quality hydraulic oil will generally have less than 100 ml foam tendency for each of sequence I, II, and III; and zero ml foam stability for each of sequence I, II, III; the lower the foam tendency of a lubricating base oil or hydraulic oil the better. The hydraulic oils of this invention have much lower foaming tendency than typical hydraulic oils. They preferably have a sequence I foam tendency less than 50 ml; they have a sequence II foam tendency less than 50 ml, preferably less than 30 ml; and they preferably have a sequence III foam tendency less than 50 ml.

The antiwear additive may be an additive package provided by an additive company or formulated by a lubricant formulator. A preferred additive package is an AW hydraulic oil additive package, more preferably one that meets the Denison HF-0 standard. It may be an ashless, zinc-free, or a zinc-based AW hydraulic oil additive package. Preferred AW hydraulic oil additive packages designed to meet the Denison HF-O standard will also meet the AFNOR wet filterability test. The Denison HF-0 standard concerns hydraulic oils for use in axial piston pumps and vane pumps in severe duty applications. The HF-0 standard specifies high thermal stability, good rust prevention, high hydrolytic stability, good oxidation stability, low foaming, excellent filterability with and without water, and satisfactory performance in proprietary Denison pump tests. In addition the HF-0 standard specifies the hydraulic oil have a viscosity index greater than 90, and a minimum aniline point of 100 degrees C. (212 degrees F.). The requirements for the Denison HF-0 standard are summarized below.

Denison HF-0 Standard

| Requirements | Method | HF-0 |
|---|---|---|
| Viscosity Index | ASTM D 567 | ≧90 |
| Foam Test | ASTM D 892 | None |
| Allowable foam after 10 minutes | | |
| Aniline Point, ° C. | | ≧100 |
| Rust | ASTM D 665A | Pass |
| | ASTM D 665B | Pass |
| Thermal Stability | CINCINNATI | |
| Sludge, mg. | MILACRON Proc A. | ≦100 |
| Copper Weight Loss, mg. | (135° C., 168 hr) | ≦10 |
| Copper rod rating | | Report |
| Hydrolytic Stability | ASTM D 2619 | |
| Copper Weight Loss, mg. | | ≦0.2 |
| Water layer acidity, mg KOH/g | | ≦4.0 |
| Filterability | Denison TP 02100 | |
| Without water, seconds | | ≦600 |
| With 2% water | | ≦2 × time without water |
| Oxidation (1000 hours) | ASTM D 4310 | |
| Acid Number, mg KOH/g | | ≦2.0 |
| Total Sludge, mg | | ≦200 |
| Total metals in oil/water/sludge | | |
| Copper, mg | | ≦50 |
| Iron, mg | | ≦50 |
| Denison Pump Tests | DENISON Vane & Axial Piston Pump | Satisfactory |

Wet filterability may be measured by the Denison TP 02100 test method or the AFNOR NFE 48-691 standard. For example, only fluids passing AFNOR NFE 48-691 are specified for injection molding hydraulic oils. The latter test measures filtration in the presence of water for an aged oil, which more closely replicates actual operating conditions. The tests measure the times taken to filter initial and subsequent volumes of oil, which are then used to calculate the Index of Filtration (IF). The closer the IF is to one, the lower the tendency to clog filters over time and therefore the more desirable the oil.

The number of minutes to 3 ml emulsion at 54 degrees C. is a measure of the demulsibility of the hydraulic oil. Demulsibility is measured by ASTM D 1401-02. A 40-ml sample of oil and 40 ml of distilled water are put into a 100-ml graduate cylinder. The mixture is stirred for 5 minutes while maintained at a temperature of 130° F. The time required for separation of the emulsion into its oil and water components is recorded. If, at the end of 30 minutes, 3 or more milliliters of emulsion still remain, the test is discontinued and the milliliters of oil, water, and emulsion are reported. The 3 measurements are presented in that order and are separated by hyphens. Test time, in minutes, is shown in parenthesis. Preferably the hydraulic oils of this invention will have excellent demulsibility. That is, the number of minutes to 3 ml emulsion at 54 degrees C. by ASTM D 1401-02 is preferably less than 30 minutes, more preferably less than 20 minutes.

Liquids that contain mixtures of different types of molecules result in the stabilization of thin layers of liquid at the air/liquid interface which slows the release of entrained air bubbles, thereby forming foam. Foaming will vary in different base oils but can be controlled by the addition of antifoam agents. Generally, the hydraulic oils of this invention will usually not require the addition of antifoam agents in addition to the hydraulic oil additive package. Most hydraulic oil additive packages include antifoam agents. However, hydraulic oil blends of a higher viscosity or additionally comprising other base oils may exhibit foaming. Examples of antifoam agents are silicone oils, polyacrylates, acrylic polymers, and fluorosilicones.

Antifoam agents work by destabilizing the liquid film that surrounds entrained air bubbles. To be effective they must spread effectively at the air/liquid interface. According to theory, the antifoam agent will spread if the value of the spreading coefficient, S, is positive. S is defined by the following equation: $S=p_1-p_2-p_{1,2}$, wherein $p_1$ is the surface tension of the foamy liquid, $p_2$ is the surface tension of the antifoam agent, and $p_{1,2}$ is the interfacial tension between them. Surface tension and interfacial tensions are measured using a ring type tensiometer by ASTM D 1331-89, "Surface and Interfacial Tension of Solutions of Surface-Active Agents". With respect to the current invention, p1 is the surface of the hydraulic oil prior to the addition of antifoam agent.

Preferred choices of antifoam agents in the hydraulic oils of this invention are antifoam agents that when blended into the hydraulic oil will exhibit spreading coefficients of at least 2 mN/m at both 24 degrees C. and 93.5 degrees C. Various types of antifoam agents are taught in U.S. Pat. No. 6,090,758. When used, the antifoam agents should not significantly increase the air release time of the hydraulic oil. One preferred antifoam agent is high molecular weight polydimethyl siloxane, a type of silicone antifoam agent. Another preferred choice of antifoam agent in the hydraulic oils of this invention are acrylate antifoam agents, as they are less likely to adversely effect air release properties compared to lower molecular weight silicone antifoam agents.

Specific Analytical Test Methods:

Wt% Olefins:

The Wt % Olefins in the lubricant base oils of this invention is determined by proton-NMR by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:

6.0-4.5 ppm (olefin)

2.2-1.9 ppm (allylic)

1.9-0.5 ppm (saturate)

D. Using the molecular weight of the test substance determined by ASTM D 2503, calculate:

1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=Olefin integral/integral per hydrogen)
6. The number of double bonds (=Olefin hydrogen times hydrogens in olefin formula/2)
7. The wt % olefins by proton NMR=100 times the number of double bonds times the number of hydrogens in a typical olefin molecule divided by the number of hydrogens in a typical test substance molecule.

The wt % olefins by proton NMR calculation procedure, D, works best when the % olefins result is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the lubricant base oils of this invention uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the -electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino -bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Molecular Composition by FIMS:

The lubricant base oils of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the base oil to be tested in a glass capillary tube. The capillary tube was placed at the tip of a solids probe for a mass spectrometer, and the probe was heated from about 40 to 50° C. up to 500 or 600° C. at a rate between 50° C. and 100° C. per minute in a mass spectrometer operating at about $10^{-6}$ torr. The mass spectrometer was scanned from m/z 40 to m/z 1000 at a rate of 5 seconds per decade.

The mass spectrometers used were a Micromass Time-of-Flight and a Micromass VG70VSE. Results from the two different instruments were assumed to be equivalent. Response factors for all compound types were assumed to be 1.0, such that weight percent was determined from area percent. The acquired mass spectra were summed to generate one "averaged" spectrum.

The lubricant base oils of this invention were characterized by FIMS into alkanes and molecules with different numbers of unsaturations. The molecules with different numbers of unsaturations may be comprised of cycloparaffins, olefins, and aromatics. If aromatics were present in significant amounts in the lubricant base oil they would be identified in the FIMS analysis as 4-unsaturations. When olefins were present in significant amounts in the lubricant base oil they would be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality in the lubricant base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl) naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl) cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

Alkyl Branches per 100 Carbons:

The branching properties of the lubricant base oils of the present invention were determined by analyzing a sample of oil using carbon −13 NMR according to the following seven-step process. References cited in the description of the process provide details of the process steps. Steps 1 and 2 are performed only on the initial materials from a new process.

1) Identify the CH branch centers and the CH3 branch termination points using the DEPT Pulse sequence (Doddrell, D. T.; D. T. Pegg; M. R. Bendall, Journal of Magnetic Resonance 1982, 48, 323ff.).

2) Verify the absence of carbons initiating multiple branches (quaternary carbons) using the APT pulse sequence (Patt, S. L.; J. N. Shoolery, Journal of Magnetic Resonance 1982, 46, 535ff.).

3) Assign the various branch carbon resonances to specific branch positions and lengths using tabulated and calculated values (Lindeman, L. P., Journal of Qualitative Analytical Chemistry 43, 1971 1245ff; Netzel, D. A., et.al., Fuel, 60, 1981, 307ff).

EXAMPLES

| Branch | NMR Chemical Shift (ppm) |
|---|---|
| 2-methyl | 22.5 |
| 3-methyl | 19.1 or 11.4 |
| 4-methyl | 14.0 |
| 4+methyl | 19.6 |
| Internal ethyl | 10.8 |
| Propyl | 14.4 |
| Adjacent methyls | 16.7 |

4) Quantify the relative frequency of branch occurrence at different carbon positions by comparing the integrated intensity of its terminal methyl carbon to the intensity of a single carbon (=total integral/number of carbons per molecule in the mixture). For the unique case of the 2 methyl branch, where both the terminal and the branch methyl occur at the same resonance position, the intensity was divided by two before doing the frequency of branch occurrence calculation. If the 4-methyl branch fraction is calculated and tabulated, its contribution to the 4+methyls must be subtracted to avoid double counting.

5) Calculate the average carbon number. The average carbon number may be determined with sufficient accuracy for lubricant materials by dividing the molecular weight of the sample by 14 (the formula weight of CH2).

6) The number of branches per molecule is the sum of the branches found in step 4. 7) The number of alkyl branches per 100 carbon atoms is calculated from the number of branches per molecule (step 6) times 100 divided by the average carbon number.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and CH3 up and CH2 180 degrees out of phase (down). APT is Attached Proton Test. It allows all carbons to be seen, but if CH and CH3 are up, then quaternaries and CH2 are down. The sequences are useful in that every branch methyl should have a corresponding CH. And the methyls are clearly identified by chemical shift and phase. Both are described in the references cited. The branching properties of each sample were determined by C-13 NMR using the assumption in the calculations that the entire sample was isoparaffinic. Corrections were not made for n-paraffins or cycloparaffins, which may have been present in the oil samples in varying amounts. The cycloparaffins content was measured using Field Ionization Mass Spectroscopy (FIMS).

Boiling Range Distribution:

Lubricant base oils made by hydroisomerization dewaxing a waxy feed may comprise a mixture of varying molecular weights having a wide boiling range. This disclosure will refer to the 10 percent point and the 90 percent point of the respective boiling ranges. The 10 percent point refers to that temperature at which 10 weight percent of the hydrocarbons present within that cut will vaporize at atmospheric pressure. Similarly, the 90 percent point refers to the temperature at which 90 weight percent of the hydrocarbons present will vaporize at atmospheric pressure. In this disclosure when referring to boiling range distribution, the boiling range between the 10 percent and 90 percent boiling points is what is being referred to. For samples having a boiling range above 1000 degrees F., the boiling range distributions in this disclosure were measured using the standard analytical method D-6352 or its equivalent. For samples having a boiling range below 1000 degrees F., the boiling range distributions in this disclosure were measured using the standard analytical method D-2887 or its equivalent.

Process to Make the Lubricant Base Oil:

Feeds used to prepare the lubricant base oil according to the process of the invention are waxy feeds containing greater than 75 weight percent normal paraffins, preferably at least 85 weight percent normal paraffins, and most preferably at least 90 weight percent normal paraffins. The waxy feed may be a conventional petroleum derived feed, such as, for example, slack wax, or it may be derived from a synthetic feed, such as, for example, a feed prepared from a Fischer-Tropsch synthesis. A major portion of the feed should boil above 650 degrees F. Preferably, at least 80 weight percent of the feed will boil above 650 degrees F., and most preferably at least 90 weight percent will boil above 650 degrees F. Highly paraffinic feeds used in carrying out the invention typically will have an initial pour point above 0 degrees C., more usually above 10 degrees C.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of lubricant base oils having a very high viscosity index.

The waxy feed useful in this invention has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricant base oil contain a high proportion of wax which makes them ideal candidates for processing into lubricant base oil. Accordingly, Fischer-Tropsch wax represents an excellent feed for preparing high quality lubricant base oils according to the process of the invention. Fischer-Tropsch wax is normally solid at room temperature and, consequently, displays poor low temperature properties, such as pour point and cloud point. However, following hydroisomerization of the wax, Fischer-Tropsch derived lubricant base oils having excellent low temperature properties may be prepared. A general description of the hydroisomerization dewaxing process may be found in U.S. Pat. Nos. 5,135,638 and 5,282,958; and U.S. patent application Ser. No. 10/744,870 filed December 23, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the lubricant base oil. Preferred hydroisomerizing conditions useful in the current invention include temperatures of 260 degrees C. to about 413 degrees C. (500 to about 775 degrees F.), a total pressure of 15 to 3000 psig, and a hydrogen to feed ratio from about 0.5 to 30 MSCF/bbl, preferably from about 1 to about 10 MSCF/bbl. Generally, hydrogen will be separated from the product and recycled to the isomerization zone.

The hydroisomerization conditions are preferably tailored to produce one or more fractions having greater than 5 weight percent molecules with monocycloparaffinic functionality, more preferably having greater than 10 weight percent molecules with monocycloparaffinic functionality. The fractions will have a viscosity index greater than 140 and a pour point less than zero degrees C. Preferably the pour point will be less than −10 degrees C.

Optionally, the lubricant base oil produced by hydroisomerization dewaxing may be hydrofinished. The hydrofinishing may occur in one or more steps, either before or after fractionating of the lubricant base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the lubricant base oil to less than 10, preferably less than 5, more preferably less than 1, and most preferably less than 0.5. The hydrofinishing step may also be needed to reduce the weight percent aromatics to less than 0.3, preferably less than 0.06, more preferably less than 0.02, and most preferably less than 0.01.

In a preferred embodiment the hydroisomerizing and hydrofinishing conditions in the process of this invention are tailored to produce one or more selected fractions of lubricant base oil having less than 0.06 weight percent aromatics, less than 5 weight percent olefins, and greater than 5 weight percent molecules with cycloparaffinic functionality.

The lubricant base oil fractions of this invention have an average molecular weight greater than 475, preferably in a range between about 500 and about 900. Molecular weight is preferably measured by ASTM D 2503, but other methods giving comparable results (such as ASTM D 2502) may also be used. They also have a very high viscosity index, generally greater than 140, but they may also have an even higher viscosity index greater than an amount calculated by the equation: Viscosity Index=28×Ln(Kinematic Viscosity at 100° C., in cSt)+95; wherein Ln refers to the natural logarithm to the base 'e'. Viscosity index is determined by ASTM D 2270-93(1998).

The lubricant base oil fractions have measurable quantities of unsaturated molecules measured by FIMS. Preferably they have greater than 5 weight percent molecules with monocycloparaffinic functionality, more preferably greater than 10. They preferably have a ratio of weight percent molecules with monocycloparaffin functionality to weight percent molecules with multicycloparaffinic functionality greater than 6, preferably greater than 15, more preferably greater than 40. The presence of predominantly molecules with monocycloparaffinic functionality in the lubricant base oil fractions provides excellent oxidation stability as well as desired additive solubility and elastomer compatibility. The lubricant base oil fractions have a weight percent olefins less than 10, preferably less than 5, more preferably less than 1, and most preferably less than 0.5. The lubricant base oil fractions preferably have a weight percent aromatics less than 0.3, more preferably less than 0.06, and most preferably less than 0.02.

The lubricant base oil fractions useful in this invention ideally have low levels of alkyl branches per 100 carbons, preferably less than 8 alkyl branches per 100 carbons, more preferably less than 7. The branches are alkyl branches and they are preferably predominantly methyl branches (—$CH_3$). In addition, the alkyl branches are preferably positioned over various branch carbon resonances by carbon-13 NMR. The low levels of predominantly methyl branches impart high viscosity index and good biodegradability to the lubricating base oils, and hydraulic oils made from them.

Preferably the lubricant base oil fractions of this invention will have T90-T10 boiling point distributions less than 180 degrees F., more preferably between 50 degrees F. and less than 180 degrees F., and most preferably between 90 and less than 150 degrees F.

In preferred embodiments, where the olefin and aromatics contents are significantly low in the lubricant base oil fraction of the hydraulic oil, the Oxidator BN of the lubricant base oil will be greater than 25 hours, preferably greater than 35 hours, more preferably greater than 40 hours. Oxidator BN is a convenient way to measure the oxidation stability of lubricating base oils. The Oxidator BN test is described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of O2 by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application.

High values, or long times to absorb one liter of oxygen, indicate good oxidation stability. Traditionally it is considered that the Oxidator BN should be above 7 hours, but the Oxidator BN of the lubricant base oil fractions of this invention are preferably much higher.

OLOA is an acronym for Oronite Lubricating Oil Additive®, which is a registered trademark of Chevron Oronite.

Hydraulic Pump Operation:

Hydraulic oil reservoirs must be filled to a sufficient volume to provide adequate lubrication, sufficient pressure head, and good coverage of pump suction inlets. Most hydraulic oil systems are marked with minimum fill lines. In general, the oil reservoir should be filled with hydraulic oil to the level indicated by the system operation manual, to a marked fill line, or at a minimum to a level about 3 inches above the top of the highest pump suction inlet when all hydraulic system cylinders are fully extended.

Hydraulic oil reservoirs are sized and designed such that there is adequate residence time for the hydraulic fluid to release air and bubbles. When a hydraulic oil has improved air release and less tendency to form foam and very low foam stability the hydraulic system may be designed with smaller oil reservoirs or less oil residence time. It may not be as critical that the oil reservoir be filled to the level indicated by the system operation manual. Even with a small oil reservoir or shorter oil residence time the pump may be operated without cavitation when the hydraulic oil has excellent air release and foaming properties. This can be very useful where space is limited. Examples of where space could be limited are in aircraft, elevator, mobile equipment, or other hydraulic systems where space and weight are significant considerations.

Hydraulic pumps may be operated at higher pump speeds when they are operated with a hydraulic oil having improved air release and foaming tendency. The flow rate or capacity of a hydraulic pump is directly proportional to the pump speed; the discharge head is directly proportional to the square of the pump speed; and the power required by the pump motor is directly proportional to the cube of the pump speed.

The invention will be further explained by the following illustrative examples that are intended to be non-limiting.

EXAMPLES

Example 1

A sample of hydrotreated Fischer-Tropsch wax made using a Fe-based Fischer-Tropsch catalyst was analyzed and found to have the properties as shown in Table I.

TABLE I

| Fischer-Tropsch Wax | |
|---|---|
| Fischer-Tropsch Catalyst | Fe-Based |
| Sulfur, ppm | <2 |
| Nitrogen, ppm | <8 |
| Oxygen by Neutron Activation, Wt % | 0.15 |
| Oil Content, D 721, Wt % | <1 |
| GC N-Paraffin Analysis | |
| Total Normal Paraffin, Wt % | 92.15 |
| Average Carbon Number | 41.6 |
| Average Molecular Weight | 585.4 |
| D 6352 SIMDIST TBP (WT %), ° F. | |
| T0.5 | 784 |
| T5 | 853 |
| T10 | 875 |
| T20 | 914 |
| T30 | 941 |
| T40 | 968 |
| T50 | 995 |
| T60 | 1013 |
| T70 | 1031 |
| T80 | 1051 |
| T90 | 1081 |
| T95 | 1107 |
| T99.5 | 1133 |
| T90-T10, ° C. | 114.5 |
| Wt % C30+ | 96.9 |

TABLE I-continued

| Fischer-Tropsch Wax | |
|---|---|
| Fischer-Tropsch Catalyst | Fe-Based |
| Wt % C60+ | 0.55 |
| C60+/C30+ | 0.01 |

The Fischer-Tropsch wax was hydroisomerized over a Pt/SAPO-11 catalyst with an alumina binder. Operating conditions included temperatures between 652° F. and 695° F. (315° C. and 399° C.), LHSV of 0.6 to 1.0 $hr^{-1}$, reactor pressure of 1000 psig, and once-through hydrogen rates of between 6 and 7 MSCF/bbl. The reactor effluent passed directly to a second reactor containing a Pt/Pd on silica-alumina hydrofinishing catalyst also operated at 1000 psig. Conditions in the second reactor included a temperature of 450° F. (232° C.) and an LHSV of 1.0 $hr^{1}$.

The products boiling above 650° F. were fractionated by vacuum distillation to produce distillate fractions of different viscosity grades. Three Fischer-Tropsch derived lubricant base oils were obtained. Two were distillate side-cut fractions (FT-4.5 and FT-6.3) and one was a distillate bottoms fraction (FTB-9.8). FTB-9.8 was an example of the lubricant base oils that are useful in this invention. The FIMS analyses were conducted on a Micromass VG70VSE mass spectrometer. The probe in the spectrophotometer was heated from about 40 to 500° C. at a rate of 50° C. per minute. Test data on the three Fischer-Tropsch derived lubricant base oils are shown in Table II, below.

TABLE II

| Fischer-Tropsch Derived Lubricant Base Oils | | | |
|---|---|---|---|
| Properties | FT-4.5 | FT-6.3 | FTB-9.8 |
| Viscosity at 100° C., cSt | 4.524 | 6.295 | 9.83 |
| Viscosity Index | 149 | 154 | 163 |
| Average Molecular Weight, ASTM D2503 or D2502 | 420 | 470 | 538 |
| Wt % Aromatics | 0.0109 | 0.0141 | 0.0162 |
| Wt % Olefins by Proton NMR | 1.1 | 0.40 | 0.0 |
| Formula Olefin H | 59.7 | 66.9 | 86.6 |
| Saturate H | 61.7 | 68.9 | 88.6 |
| Total Integral | 3058 | 8026 | — |
| div/H | 49.55 | 116.56 | 0.054 |
| Olefin integral | 1.14 | 1.0 | — |
| Olefin H | 0.023 | 0.009 | 0.0 |
| Sample olefin H | 0.687 | 0.287 | 0.0 |
| Aniline Point, ° F. | 253.2 | 263.0 | 278.6 |
| NMR - Alkyl branches per 100 carbons | 7.48 | 7.21 | 6.63 |
| FIMS, Wt % of Molecules | | | |
| Alkanes | 89.4 | 76.0 | 81.3 |
| 1-Unsaturations | 10.4 | 22.1 | 16.4 |
| 2-6-Unsaturations | 0.2 | 1.9 | 2.3 |
| Total | 100.0 | 100.0 | 100.0 |
| Total Wt % of Molecules Having Cycloparaffinic Functionality | 9.49 | 23.59 | 18.68 |
| Ratio of Molecules with Monocycloparaffinic Functionality to Molecules with Multicycloparaffinic Functionality | 48.9 | 11.5 | 7.2 |
| SIMDIS (Wt %), ° F. | | | |
| 5 | 716 | 827 | 911 |
| 10 | 732 | 841 | 921 |
| 20 | 763 | 863 | 936 |
| 30 | 792 | 881 | 948 |
| 50 | 843 | 912 | 971 |
| 70 | 883 | 943 | 999 |
| 90 | 917 | 982 | 1050 |
| 95 | 929 | 996 | 1074 |
| Boiling Range Distribution T90-T10 | 185 | 87 | 129 |
| Oxidator BN, hours | 34.92 | 29.62 | 35.12 |

Example 2

The Fischer-Tropsch derived lubricant base oils prepared above (FT-4.5, FT-6.3, and FTB-9.8) were blended with either a zinc antiwear hydraulic oil additive package designed to meet Denison HF-0 and AFNOR NFE 48-691 wet filterability standards or an ashless antiwear hydraulic oil additive package designed to meet Denison HF-0. A comparison blend with polyalphaolefin base oil and the zinc antiwear hydraulic oil additive package designed to meet HF-0 and AFNOR NFE 48-691 wet filterability standards was also prepared. All of these blends were ISO 32 grade. The compositions of the hydraulic oils are shown below in Table III.

TABLE III

| Composition of Hydraulic Oils from Fe-Based Fischer-Tropsch Wax | | | | |
|---|---|---|---|---|
| Component | Oil 1 | Oil 2 | Comparative Oil 3 | Comparative Oil 4 |
| FTB-9.8 | 99.15 | 98.75 | 0 | |
| FT-4.5 | | | 49.575 | |
| FT-6.3 | | | 49.575 | |
| Polyalphaolefin Base Oil | | | 0 | 99.15 |
| Zinc Antiwear HF-0 Additive Package | 0.85 | 0 | 0.85 | 0.85 |
| Ashless Antiwear HF-0 Additive Package | 0 | 1.25 | 0 | 0 |

Oils 1 and 2 are both hydraulic oils of this invention. They both comprise: 1) a lubricant base oil (FT-9.8) having: an average molecular weight greater than 475, a VI greater than 140, a weight percent olefins less than 10; and 2) an antiwear hydraulic oil additive package. The lubricant base oil used in Oils 1 and 2 had a preferred level of less than about 8 alkyl branches per 100 carbons, which would give these hydraulic oils improved biodegradability.

The hydraulic oils were tested in a number of tests related to hydraulic oil performance. Storage stability tests were used to observe the additive solvencies over a 4 week period. The storage conditions were room temperature (approximately 25° C.), 65° C., 0° C., or −18° C. The additive solvency observations were made at both the test temperatures, and (after warming, when required) at room temperature. The results of these tests are summarized in Table IV.

TABLE IV

| ISO 32 Hydraulic Oils | | | | |
|---|---|---|---|---|
| Properties | Oil 1 | Oil 2 | Comparative Oil 3 | Comparative Oil 4 |
| Air Release (D 3427) | | | | |
| 50° C. | <0.1 | Not tested | 1.3 | 1.0 |
| 25° C. | 2.4 | | Not tested | Not tested |

TABLE IV-continued

| ISO 32 Hydraulic Oils | | | | |
|---|---|---|---|---|
| Properties | Oil 1 | Oil 2 | Comparative Oil 3 | Comparative Oil 4 |
| Demulsibility (D1401) Oil-Water-Emulsion (minutes) | 39-40-1 (15) | Not tested | 7-36-37 (30) | 40-40-0 (10) |
| Foam (D 892) | | | | |
| Seq I | 10-0 | Not tested | 110-0 | 20-0 |
| Seq II | 0-0 | | 20-0 | 20-0 |
| Seq III | 10-0 | | 90-0 | 20-0 |
| Storage Stability | | | | |
| RT @ 4 Wks | C | C | C | C |
| 65° C. @ 4 Wks | C | C | C | C |
| 0° C. at RT @ 4 Wks | C | C | Sep. | C |
| −18° C. at RT @ 4 Wks | C | C | C | C + T |
| Storage Stability Codes | C = clear | C = clear | Sep. = separated | T = trace of haze |

The air release properties of Oil 1 were better than for Comparative Oil 3; which also comprised Fischer-Tropsch derived lubricant base oils, but not of the preferred composition of this invention. Neither of the base oils used in Comparative oil 3 had an average molecular weight greater than 475. The air release properties of Oil 1 were also better than a high performance hydraulic oil made with polyalphaolefin base oil (Oil 4). The polyalphaolefin base oil used in Comparative Oil 4 did not have the high viscosity index of the lubricant base oils of this invention. The excellent additive solubility of Oils 1 and 2 is attributed to the preferred cycloparaffin composition of the lubricant base oil used in these blends (FT-9.8). The FT-9.8 has greater than 5 weight percent molecules with cycloparaffinic functionality and the ratio of molecules with monocycloparaffinic functionality to molecules with multicycloparaffinic functionality is greater than 6.

It is surprising that the hydraulic oils having the Fischer-Tropsch derived lubricant base oil with the highest molecular weight and highest aniline point showed the best air release, additive solubility, and foaming tendencies. Typically better air release is expected with lower viscosity (thus lower molecular weight) base oil, and typically better additive solubility is expected with base oils having lower aniline points.

Example 3

Five commercial Group II base oils were obtained for blending ISO 32 grade hydraulic oils. Their typical properties were as shown below:

TABLE V

| Commercial Group II Base Oils | | | | | |
|---|---|---|---|---|---|
| Properties | Pennzoil 100HC | Motiva Star 4 | Motiva Star 7 | Chevron 100R | Chevron 220R |
| Viscosity at 100° C., cSt | 4.1 | 4.0 | 7.6 | 4.1 | 6.4 |
| Viscosity Index | 100 | 105 | 102 | 102 | 103 |

Four different blends of Chevron Rykon Oil AW ISO 32 were blended using the commercial Group II base oils. Chevron Rykon Oil AW is an antiwear hydraulic oil with a zinc antiwear HF-0 Additive Package. The amount of the additive package is between 0.75 to 1.50 weight percent. The additive package includes an acrylate foam inhibitor, which typically gives a better air release result than silicone foam inhibitors in this product. The base oils used in these blends all had viscosity indexes less than 140.

The formulations and the air release results are shown below:

TABLE VI

| Hydraulic Oils Made with Commercial Group II Base Oils | | | | |
|---|---|---|---|---|
| Properties | Comparative Oil A | Comparative Oil B | Comparative Oil C | Comparative Oil D |
| Base Oils | Pennzoil 100HC & Motiva Star 4 | Pennzoil 100HC & Pennzoil 260HC | Motiva Star 4 & Motiva Star 7 | Chevron 100R & Chevron 220R |
| Air Release @ 50° C. (D3427) | 0.9 minutes | 1.3 minutes | 1.7 minutes | 2.5 minutes |

None of these comparative examples had the excellent air release of the hydraulic oils of our invention.

Example 4

Three commercial Chevron Phillips polyalphaolefin base oils were tested, to compare their properties to the base oils that are useful in this invention. The FIMS analyses were conducted on a Micromass VG70VSE mass spectrometer. The probe in the spectrophotometer was heated from about 40 to 500° C. at a rate of 50° C. per minute. The test results are summarized in the following table, Table VII.

TABLE VII

| Commercial Polyalphaolefin Base Oils | | | |
|---|---|---|---|
| | Product | | |
| | PAO 4 | PAO 6 | PAO 8 |
| Kinematic Viscosity at 100° C., cSt | 3.823 | 5.896 | 7.795 |
| VI | 124 | 138 | 136 |
| Wt % Olefins | 0.83 | 1.44 | 2.30 |
| Molecular Weight | 436 | 512 | 587 |
| FIMS | | | |
| Alkanes | 93.50 | 82.15 | 87.92 |
| 1-Unsaturations | 6.50 | 17.85 | 12.08 |
| 2-6-Unsaturations | 0.00 | 0.00 | 0.00 |
| Total % | 100.00 | 100.00 | 100.00 |
| Oxidator BN, Hrs | 26.6 | 18.97 | 24.15 |
| Aniline Point, F | 246.7 | 260.2 | 270.1 |
| Boiling Range Distribution T90-T10 | 120 | 198 | 133 |

All of these polyalphaolefin base oils had viscosity indexes less than 140, unlike the lubricating base oils that are useful in this invention. Hydraulic oils blended with any of these base oils would not have the low air release properties of the hydraulic oils of this invention. Another distinction between polyalphaolefins and the base oils preferred in this invention are that polyalphaolefins do not contain hydrocarbon molecules having consecutive numbers of carbon atoms. Polyalphaolefins are small aliphatic molecules with branching of long alkyl chains at 2-, 4-, 6-, etc. positions, the positions depending upon the extent of oligomerization. Unlike polyalphaolefins, the lubricant base oils preferred in our invention contain hydrocarbon molecules having consecutive numbers of carbon atoms.

Example 5

A wax sample composed of several different batches of hydrotreated Fischer-Tropsch wax, all made using a Co-based Fischer-Tropsch catalyst was prepared. The different batches of wax composing the wax sample were analyzed and all found to have the properties as shown in Table VII.

TABLE VIII

| Fischer-Tropsch Wax | |
|---|---|
| Fischer-Tropsch Catalyst | Co-Based |
| Sulfur, ppm | <10 |
| Nitrogen, ppm | <10 |
| Oxygen, wt % | <0.50 |
| Wt % N-Paraffins by GC | >85 |
| D 6352 SIMDIST TBP (WT %), ° F. | |
| T10 | 550-700 |
| T90 | 1000-1080 |
| T90-T10, ° C. | >154 |

The Co-based Fischer-Tropsch wax was hydroisomerized over a Pt/SAPO-11 catalyst with an alumina binder. Operating conditions included temperatures between 635° F. and 675° F. (335° C. and 358° C.), LHSV of 1.0 $hr^{-1}$, reactor pressure of about 500 psig, and once-through hydrogen rates of between 5 and 6 MSCF/bbl. The reactor effluent passed directly to a second reactor containing a Pd on silica-alumina hydrofinishing catalyst also operated at 500 psig. Conditions in the second reactor included a temperature of about 350° F. (177° C.) and an LHSV of 2.0 $hr^{-1}$.

The products boiling above 650° F. were fractionated by vacuum distillation to produce two distillate fractions of different viscosity grades. They were both distillate side-cut fractions (FT-6.4 and FT-9.7). The FIMS analysis was conducted on a Micromass Time-of-Flight spectrophotometer. The emitter on the Micromass Time-of-Flight was a Carbotec 5 um emitter designed for Fl operation. A constant flow of pentaflourochlorobenzene, used as lock mass, was delivered into the mass spectrometer via a thin capillary tube. The probe was heated from about 50° C. up to 600° C. at a rate of 100° C. per minute. Test data on the two Fischer-Tropsch derived lubricant base oils are shown in Table IX, below.

TABLE IX

| Fischer-Tropsch Derived Lubricant Base Oils | | |
|---|---|---|
| Properties | FT-6.4 | FT-9.7 |
| Viscosity at 100° C., cSt | 6.362 | 9.716 |
| Viscosity Index | 153 | 161 |
| Average Molecular Weight | 518 | 582 |
| Wt % Aromatics | 0.059 | Not tested |
| Wt % Olefins | 3.5 | 12.9 |
| Aniline Point, ° F. | 263 | Not tested |
| NMR - Alkyl branches per 100 carbons | 10.13 | 7.56 |
| FIMS, Wt % of Molecules | | |
| Alkanes | 68.1 | 60.9 |
| 1-Unsaturations | 31.2 | 35.7 |
| 2-6-Unsaturations | 0.7 | 3.4 |
| Total | 100.0 | 100.0 |
| Total Wt % of Molecules Having Cycloparaffinic functionality | 28.3 | 26.2 |
| Total Wt % of Molecules Having Monocycloparaffinic functionality | 27.2 | 22.8 |
| Total Wt % of Molecules Having Multicycloparaffinic functionality | 0.64 | 3.4 |

TABLE IX-continued

| Fischer-Tropsch Derived Lubricant Base Oils | | |
|---|---|---|
| Properties | FT-6.4 | FT-9.7 |
| Ratio of Molecules with Monocycloparaffinic Functionality to Molecules with Multicycloparaffinic Functionality | 42.5 | 6.7 |
| SIMDIS (Wt %), ° F. | | |
| 5 | 847 | 804 |
| 10 | 856 | 887 |
| 20 | 869 | 973 |
| 30 | 881 | 991 |
| 50 | 905 | 1012 |
| 70 | 931 | 1041 |
| 90 | 962 | 1071 |
| 95 | 972 | 1085 |
| Boiling Range Distribution T90-T10, ° F. | 106 | 184 |
| Oxidator BN, hours | 21.3 | 12.91 |

Example 6

The two Fischer-Tropsch derived lubricant base oils described above, and FT-4.5 described earlier, were blended with either a zinc antiwear hydraulic oil additive package designed to meet Denison HF-0 and AFNOR NFE 48-691 wet filterability standards or an ashless antiwear hydraulic oil additive package designed to meet Denison HF-0. All of these hydraulic oil blends were ISO 32 grade. The compositions and air release test results of the hydraulic oils are shown below in Table X.

TABLE X

| Composition of Hydraulic Oils from Co-Based Fischer-Tropsch Wax | | | |
|---|---|---|---|
| Component | Oil 5 | Oil 6 | Comparative Oil 7 |
| FT-9.7 | 0 | 0 | 49.575 |
| FT-4.5 | 0 | 0 | 49.575 |
| FT-6.4 | 99.15 | 98.75 | 0 |
| Zinc Antiwear HF-0 Additive Package | 0.85 | 0 | 0.85 |
| Ashless Antiwear HF-0 Additive Package | 0 | 1.25 | 0 |
| Air Release (D 3427) | | | |
| 50° C. | <0.1 | <0.1 | 1.13 |
| 25° C. | 0.1 | 0.1 | Not tested |

Oils 5 and 6 are both hydraulic oils of this invention. They both comprise: a lubricant base oil having: an average molecular weight greater than 475, a viscosity index greater than 140, less than 10 weight percent olefins; and an antiwear hydraulic oil additive.

The air release properties of Oils 5 and 6 were excellent. The excellent air release properties of these oils are related to the properties of the base oil used. In addition, the FT-6.4 base oil had a preferred narrow boiling point distribution, a high total weight percent molecules with monocycloparaffinic functionality, a high ratio of weight percent molecules with monocycloparaffinic functionality to weight percent molecules with multicycloparaffin functionality, and low wt % aromatics.

Comparative Oil 7 did not have the excellent air release properties of the hydraulic oils of this invention. Neither of the base oils used in the Comparative Oil 7 blend (FT-4.5 and FT-9.7) had the properties of this invention; that is, FT-4.5 had a low average molecular weight, and FT-9.7 had a weight percent olefins greater than 10.

Example 7

Two comparison ISO 32 hydraulic oils were blended from Group II base oils, either with or without the same zinc antiwear hydraulic oil additive package designed to meet Denison HF-0 and AFNOR NFE 48-691 wet filterability standards as used in Examples 1, 3, 4, 5, and 7. The composition and air release tests on these blends are shown below in Table XI.

TABLE XI

Comparison ISO 32 Hydraulic Oils

| Component | Comparative Oil E | Comparative Oil F |
|---|---|---|
| ChevronTexaco I00R | 60.24 | 60.48 |
| ChevronTexaco 220R | 38.51 | 38.67 |
| Zinc Antiwear HF-0 Additive Package | 0 | 0.85 |
| Air Release (D 3427) | | |
| 50° C. | 1.08 | 0.85 |

Again, neither of these comparison oils had the good air release of the hydraulic oils of this invention. Neither ChevronTexaco 100R nor ChevronTexaco 220R have a viscosity index greater than 140. ChevronTexaco 100R typically has a total weight percent of molecules with cycloparaffinic functionality (monocycloparaffin and multicycloparaffin) greater than 85 wt %, and a ratio of weight percent molecules with monocycloparaffinic functionality to weight percent molecules with multicycloparaffinic functionality of about 0.5. ChevronTexaco 220R typically has a total percent of molecules with cycloparaffinic functionality greater than 90 wt %, and a ratio of weight percent molecules with monocycloparaffinic functionality to weight percent molecules with multicycloparaffinic functionality of about 0.4.

Example 8

The base oils shown in Table IX are re-hydrofinished at 1000 psig to hydrogenate the olefins. As a result the wt % olefins by proton NMR in the re-hydrofinished base oils are less than 0.5 wt %. They still have average molecular weights greater than 475 and viscosity indexes greater than 140. In addition they still have greater than 10 wt % molecules with cycloparaffinic functionality, and their ratios of molecules with monocycloparaffinic functionality to weight percent molecules with multicycloparaffinic functionality are greater than 6. The oxidation stabilities of the base oils increase dramatically from less than 25 hours to greater than 35 hours in the Oxidator BN test. When the re-hydrofinished FT-6.4 or FT-9.7 lubricant base oils are blended with the same antiwear hydraulic oil additives as before in Oil 5 or Oil 6 and tested for air release, the air release at 50° C. is 0.5 minutes or less. The foam tendency and stability of the hydraulic oils are also very good. For example, the sequence II foam tendency by ASTM D 892-03 is less than 30 ml. In addition the oxidation stabilities of these new hydraulic oils blended with re-hydrofinished lubricant base oils are significantly better than for Oils 5 or 6.

What is claimed is:

1. A hydraulic oil, comprising:

a. a lubricant base oil having:

i. an average molecular weight greater than 475;

ii. a viscosity index greater than 140;

iii. a weight percent olefins less than 10; and b. an antiwear hydraulic oil additive package;

wherein the hydraulic oil has:

i. an air release by ASTM D 3427-03 of less than 0.8 minutes at 50 degrees C., and ii. a sequence II foam tendency by ASTM D 892-03 of less than 50 ml.

2. The hydraulic oil of claim 1, wherein the lubricant base oil is Fischer-Tropsch derived.

3. The hydraulic oil of claim 1, wherein the lubricant base oil additionally has an average degree of branching in the molecules less than about 8 alkyl branches per 100 carbon atoms.

4. The hydraulic oil of claim 1, wherein the lubricant base oil additionally has greater than 5 weight percent molecules with monocycloparaffinic functionality.

5. The hydraulic oil of claim 1, wherein the lubricant base oil has a ratio of weight percent molecules with monocycloparaffinic functionality to weight percent molecules with multicycloparaffinic functionality greater than 6.

6. The hydraulic oil of claim 1, wherein the lubricant base oil has a T90-T10 boiling range distribution of less than 180 degrees F.

7. The hydraulic oil of claim 1, wherein the average molecular weight is between about 500 and about 900.

8. The hydraulic oil of claim 1, wherein the weight percent olefins is less than 5.

9. The hydraulic oil of claim 1, wherein the lubricant base oil additionally has an Oxidator BN greater than 25 hours.

10. The hydraulic oil of claim 1, wherein the air release at 50 degrees C. is less than 0.5 minutes.

11. The hydraulic oil of claim 1, wherein the hydraulic oil additionally comprises an air release at 25 degrees C. less than 10 minutes.

12. The hydraulic oil of claim 1, wherein the lubricant base oil additionally has an aniline point between 212 and 300 degrees F.

13. The hydraulic oil of claim 1, wherein the hydraulic oil additionally has a sequence I foam tendency by ASTM D 892-03 of less than 50 ml.

14. The hydraulic oil of claim 1, wherein the hydraulic oil has a sequence II foam tendency by ASTM D 892-03 of less than 30 ml.

15. The hydraulic oil of claim 1, wherein the hydraulic oil additionally has a number of minutes to 3 ml emulsion at 54 degrees C. by ASTM D 1401-02 of less than 30.

16. The hydraulic oil of claim 1, wherein the hydraulic oil meets the Denison HF-0 hydraulic oil standard.

17. The hydraulic oil of claim 1, wherein the antiwear hydraulic oil additive package is selected from the group consisting of ashless, zinc-free, and zinc-containing.

18. The hydraulic oil of claim 1, wherein the hydraulic oil is selected from the group consisting of ISO 22, ISO 32, ISO 46, ISO 68, and ISO 100.

19. The hydraulic oil of claim 1, wherein the lubricant base oil has alkyl branches positioned over various branch carbon resonances by carbon −13 NMR.

20. A hydraulic oil, comprising:

a. between 10 and 99.9 weight percent based on the total hydraulic oil of a lubricant base oil having:

i. an average molecular weight greater than 475, ii. a viscosity index greater than 140, iii. a weight percent olefins less than 10; and b. between 0.1 and 15 weight percent based on the total hydraulic oil of an antiwear hydraulic oil additive package;

wherein the hydraulic oil has:

i. an air release of less than 0.8 minutes at 50 degrees C. by ASTM D 3427-03;

ii. a sequence II foam tendency by ASTM D 892-03 of less than 50 ml; and iii. a number of minutes to 3 ml emulsion at 54 degrees C. by ASTM D 1401-02 of less than 30.

21. A process for making a hydraulic oil, comprising:

a. selecting a waxy feed having:

i. greater than 75 wt % n-paraffins; and ii. less than 25 ppm total combined nitrogen and sulfur;

b. hydroisomerization dewaxing the waxy feed to produce a lubricant base oil;

c. fractionating the lubricant base oil into one or more fractions;

d. selecting one or more of the fractions having:

i. an average molecular weight greater than 475;

ii. a viscosity index greater than 140;

iii. a weight percent olefins less than 10; and e. blending the one or more selected fractions with an antiwear hydraulic oil additive package to produce a hydraulic oil having an air release at 50 degrees C. by ASTM D 3427-03 of less than 0.8 minutes.

* * * * *